United States Patent [19]

Brown

[11] Patent Number: 4,870,449

[45] Date of Patent: Sep. 26, 1989

[54] CLEANING APPARATUS WITH MAGNETIC TONER MOVER

[75] Inventor: Brandon H. Brown, Rochester, N.Y.

[73] Assignee: Eastman Kodak Company, Rochester, N.Y.

[21] Appl. No.: 216,930

[22] Filed: Jul. 8, 1988

[51] Int. Cl.[4] ..... G03G 15/00; G03G 15/08

[52] U.S. Cl. ..... 355/297; 15/256.5; 15/256.51; 118/652; 430/125; 355/298; 355/'299; 355/305

[58] Field of Search ..... 355/3 R, 3 DD, 15; 118/652; 15/256.5, 256.51, 256.53; 430/125

[56] References Cited

U.S. PATENT DOCUMENTS

| | | | |
|---|---|---|---|
| 4,515,467 | 5/1985 | Suzuki | 355/15 |
| 4,530,594 | 7/1985 | Adachi | 355/15 |
| 4,571,070 | 2/1986 | Tomita | 355/15 |
| 4,588,285 | 5/1986 | Tagoku | 355/15 |
| 4,618,250 | 10/1986 | Noguchi et al. | 355/15 |
| 4,639,123 | 1/1987 | Adachi et al. | 355/15 |
| 4,639,124 | 1/1987 | Nye, Jr. et al. | 355/15 |
| 4,641,956 | 2/1987 | Seanor | 355/15 |
| 4,685,798 | 8/1987 | Matsumoto | 355/15 |
| 4,711,561 | 12/1987 | Tsuruoka | 355/3 R |

*Primary Examiner*—A. C. Prescott

*Attorney, Agent, or Firm*—Tallam I. Nguti

[57] ABSTRACT

An apparatus for cleaning a surface includes a cleaning element, a housing for holding particles removed from the surface, a passive magnet carried by a particle moving member within the housing, and a driven magnet outside the housing for inducing movement in the passive magnet thereby causing the particle moving member to move and to spread particles within the housing.

34 Claims, 4 Drawing Sheets

CLEANING APPARATUS WITH MAGNETIC TONER MOVER

BACKGROUND OF THE INVENTION

This invention relates to electrostatographic process equipment, and more particularly, cleaning apparatus for removing toner and other particles from the image-bearing surfaces of such equipment.

Electrostatographic process equipment, which produce or reproduce toned images on selected substrates by employing electrostatic charges and toner particles on an insulated photoconductive surface, typically operate through a sequence of currently well known steps. These steps include (1) charging of the insulated photoconductive surface with electrostatic charges, (2) forming an electrostatic image on such surface by selectively discharging areas on such surface that are the equivalent of the background of the image being formed, (3) developing the electrostatic image so formed with particles of toner, (4) transferring the toned image to a suitable substrate for fusing, and (5) cleaning residual toner and other particles on the photoconductive surface in preparation for similarly producing another image.

The quality of the images produced by such equipment depends significantly on the ability to clean the photoconductive surface before it is reused.

Several types of cleaning apparatus, including blade-type cleaners, have therefore been developed for cleaning the photoconductive and other image-bearing surfaces in such equipment. The long term effectiveness of any of such cleaning apparatus, however, depends significantly on the ability of the cleaning apparatus itself to move and hold (away from the surface being cleaned) the toner and other particles it removes from such surface. As electrostatographic process equipment become more and more compact, and more and more competitive in their quality aspect, there is a need for a cleaning apparatus that can move and hold particles away from the image-bearing surfaces of such equipment, without resorting to bulky, complicated and expensive particle-moving components. Examples of cleaning apparatus with such bulky, complicated and expensive components, in the form of powered conveyors, are disclosed in U.S. Pat. Nos. 4,685,798 and 4,711,561.

It is an object of the present invention to provide a cleaning apparatus capable of long term effectiveness even in compact copiers and printers.

Another object of the present invention is to provide a simplified but effective cleaning apparatus capable of moving and holding toner and other particles away from an image-bearing surface, without resort to bulky, complicated and expensive particle-moving components.

SUMMARY OF THE INVENTION

In accordance with the present invention, a cleaning apparatus is provided for removing toner and other particles from a surface of an image-bearing member of an electrostatographic copier or printer as the surface is moved past the cleaning apparatus. The cleaning apparatus includes a particle moving member that incorporates a first magnet which generates a first magnetic field, a second magnet that generates a second magnetic field, and means for moving the second magnet past the first magnet so that the second magnetic field interacts with the first magnetic field causing the first magnet and the particle moving member to move. This magnetically induced movement of the particle moving member is especially useful for moving the toner and other particles away from the surface being cleaned.

An advantage of the present invention is that the particle moving member and the portion of the cleaning apparatus which receives and holds waste toner, can be made inexpensively enough to be periodically disposable with the waste toner.

BRIEF DESCRIPTION OF THE DRAWINGS

In the detailed description of the preferred embodiment of the invention presented below, reference is made to the accompanying drawings, in which.

DETAILED DESCRIPTION OF THE PREFERRED EMBODIMENT

Figure 1:
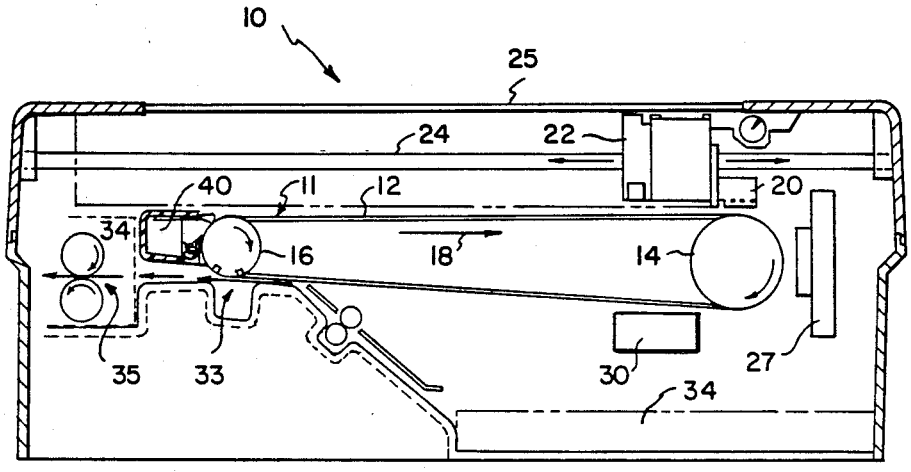
FIG. 1 is a schematic of an electrostatographic copier or printer embodying the cleaning apparatus of the present invention.

Referring now to FIG. 1, an electrostatographic copier or printer 10 includes a moving image-bearing member 11 shown in the form of an endless belt having an image-bearing surface 12. Member 11 is trained about rollers 14, 16 for movement in the direction indicated by the arrow 18. One of the rollers such as 14 can be a drive roller for moving the member 11. Alternatively, the member 11 can be a rigid drum that has an image-bearing surface 12 and is rotatable about its axis in the direction as shown by the arrow 18.

The copier or printer 10 also includes a primary charger 20 shown as an integral part of a scanner assembly 22 that travels back and forth on a member 24. The primary charger 20 deposits electrostatic charges on the moving image-bearing surface 12, and the scanner forms electrostatic images by imagewise exposing the charged surface to light reflected from a document positioned on a platen 25. Electrostatic images can also be formed on the moving charged surface by means of an electronic printhead 27.

The electrostatic images formed thus, next move past a development station 30 where charged toner particles are attracted and held by the electrostatic charges to form visible images on the surface 12. The visible images then move to a transfer station 33 where they are transferred to suitable receivers or substrates such as copy sheets of paper 34. After such transfer, the image-bearing member continues in its path about the rollers 14, 16 and the copy sheet of paper is moved to a fusing station 35 where the toner particle image is fused to form a permanent copy of the original image that was scanned by the scanner assembly 22 or printed by the printhead 27. Because the quality of the copies produced in this manner depends significantly on the cleanliness of the image-bearing surface 12, the path of the image-bearing member about the rollers 14, 16 includes a cleaning station, generally designated 40.

Figure 2:
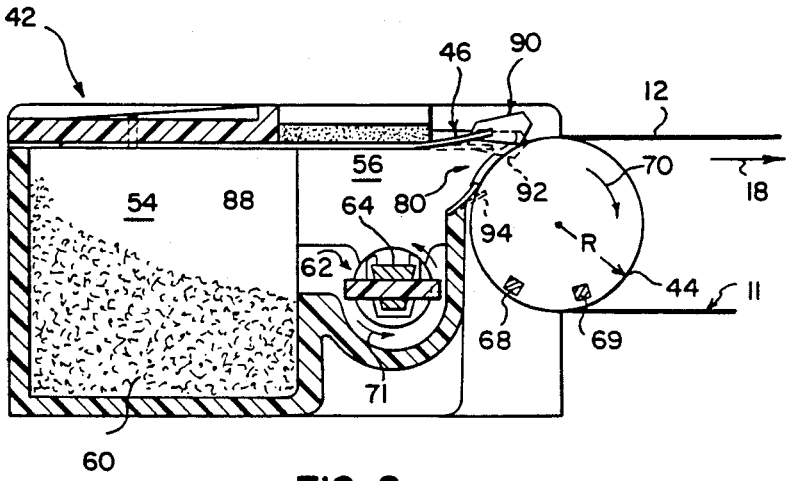
FIG. 2 is an enlarged cross-sectional view of the cleaning apparatus of the present invention.
Figure 3:
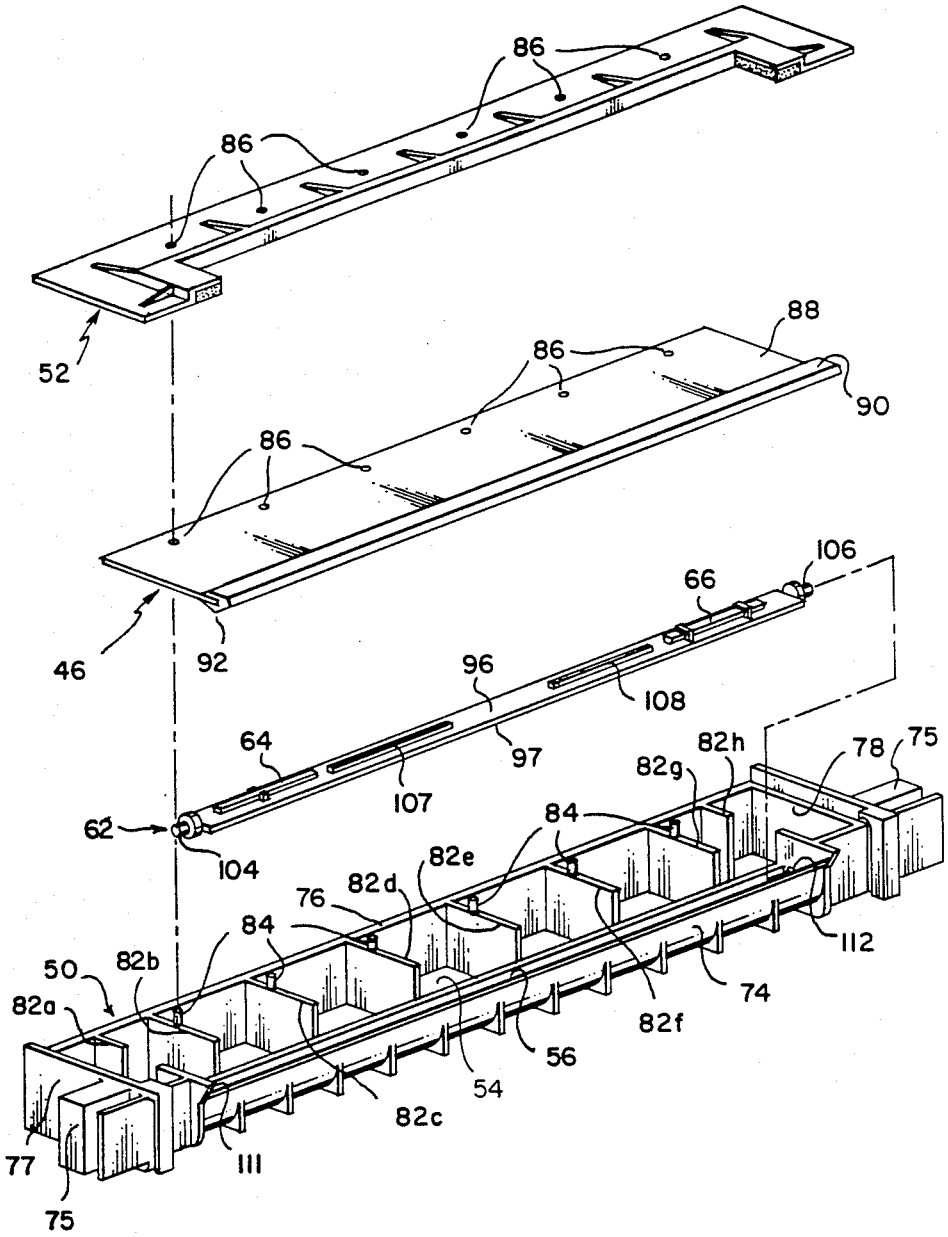
FIG. 3 is an exploded perspective view of the cleaning element and particle moving member/first magnets assembly of FIG. 4 with the waste toner housing and cover.

Referring now to FIGS. 2 and 3, the cleaning apparatus 40 includes a cleaning subassembly shown as a cartridge 42 which is suitable for mounting against a surface to be cleaned, and a driven member 44 that is positioned outside of, but in close proximity to the cartridge. The cartridge 42 consists of (a) a cleaning element 46 for removing particles such as particles of waste toner, from the surface being cleaned, (b) an elongate housing 50 that has a cover 52 and two interior portions 54, rear and 56, front, suitable for holding waste toner particles 60, and (c) a toner-moving member 62 that is supported rotatably within the housing 50 for moving waste toner.

The cleaning apparatus 40 further includes near and far end first magnets 64, 66 associated with the toner-moving member 62 within the housing 50, and near and far end second magnets 68, 69 that are mounted on and moved with the driven member 44, for example, in the direction of the arrow 70 (FIG. 2). Movement of the second magnets 68, 69 past the first magnets 64, 66, respectively, magnetically induces the first magnets and the toner-moving member 62 to rotate, for example, in the direction of the arrow 71, (FIG. 2). Such induced movement of the magnets 64, and 66 and of the member 62 can be employed within the housing 50 to move and spread waste toner and other particles over remote sections of the rear portion 54 of the housing.

Referring still to FIGS. 2 and 3, the rear and front portions 54, 56 of the housing 50, are defined by a base 72, a short front wall 74, a back wall 76, end walls 77, 78 and the cover 52. The short front wall 74 and the cover 52 define an opening 80 above such front wall. The front portion 56 which is raised relative to the rear portion 54, is troughed. The rear portion 54 is divided into sections by eight vertical partition members 82*a*, 82*b*, . . . that run parallel to the end walls 77, 78, and from the back wall 76 to the raised front portion 56. Each partition member 82 has a stub pin 84 at its top. As shown in FIG. 3, the cleaning element 46 and the cover 52, are mounted on and supported by the partition members 82*a*, 82*b* . . . , by means of the stub pins 84 which fit through corresponding pin holes 86 formed in the cleaning element and in the cover. The ends of the stub pins 84 are ultrasonically welded after the cleaning element and cover have been mounted.

The cleaning element 46, which consists of a support portion 88 and a cleaning tip 90, is mounted and supported on the partition members 82*a*, 82*b* . . . , such that the cleaning tip 90 projects beyond the front wall 74 through the opening 80. The cleaning tip 90 has a cleaning edge 92 that is suitable for removing toner and other particles from a surface such as an image-bearing surface in a copier or printer. The support portion 88 is flexible and will allow the cleaning tip 90 to flex upwards and slightly backwards when the cartridge 42 is mounted against a member to be cleaned, such as the member 11 (FIG. 2), and when the cleaning edge 92 is in contact with the surface being cleaned, for example, with the surface 12 (FIG. 2).

When the cartridge 42 is mounted for operation, the cleaning edge 92 is in cleaning contact with the surface to be cleaned, such as the surface 12, (FIG. 2). Waste toner and other particles removed from such surface, as the surface moves upwards against the edge, conveniently fall by gravity through the opening 80 and into the front portion 56 of the housing. A very thin flexible pick-up blade 94, which is attached to the top of the front wall 74 to form the bottom edge of the opening 80, and which normally projects beyond the front wall, is also flexed upwards and backwards by the surface being cleaned, upon mounting the cartridge 42. When flexed as such, the pick-up blade acts as a seal against the surface being cleaned and directs all particles removed by the cleaning edge 92 to fall into the front portion 56 of the housing. It is obvious, however, that unless the waste toner particles falling by gravity into the front portion 56 are moved out of, and away from the front portion, the particles will soon accumulate, building up in the form of a wedge against the surface being cleaned, and will shortly render the action of the cleaning tip 92 ineffective. In general, it should be understood that waste toner particles removed by a cleaning tip such as 92, and allowed to fall gravitationally into a container, even a container with an undivided interior for example, will similarly accumulate directly below the cleaning tip, and will similarly render the action of such a cleaning tip ineffective within a short period.

In the present invention, however, simplified and inexpensive means have been provided for moving the waste toner particles from the front portion 56 into the rear portion 54 such that the waste toner 60 in such rear portion wedges against the back wall 76, and not against the front wall 74 or surface 12. The result, of course, is enhanced and prolonged effectiveness of the cleaning apparatus as a whole.

Referring now to FIGS. 2 to 5, a toner-moving member 62, incorporating first magnets 64, 66, is supported for rotation within the front portion 56. The member 62 which is shown as an elongate paddle (FIGS. 3, 4 and 5), is flat with first and second sides 96, 97, first and second plow edges 101, 102 and stub shaft ends 104 and 106. The member 62 which is axially flexible, includes strengthening ribs 107, 108, formed between the plow edges 101, 102. The stub shaft ends 104, 106 of the member 62 are loaded and supported rotatably in holes 111, 112, located oppositely in the end walls, within the front portion 56. The member 62 is loaded into the holes 111, 112 simply by bending it slightly along its axis, and inserting the stubshaft ends into the holes 111, 112. Since the front portion 56 is troughed, the trough radius should be such as will allow the plow edges 101, 102 of the member 62 to sweep against the troughed base of such front portion.

The member 62 also incorporates means 114 (FIG. 4) for holding the first magnets 64, 66. Such means, as shown clearly in FIG. 4, further include an aperture 116, located between the first and second plow edges 101, 102, and passing from the first side 96 to the second side 97. First and second inclined spring arms 120 and 121 located on the first and second plow edges 101, 102 respectively on one side of the member 62, and adjacent the aperture 116, operate to retain each first magnet 64 or 66 on the one side, when such magnet is snapped into the aperture. The means 114 for holding the magnets 64, 66 further includes one or more U-shaped channel seats 122, that each straddles the aperture 116 on the other side of the member 62. The length and width of the aperture 116 is, of course, adapted to closely fit around a first magnet 64 or 66 when such magnet is loaded and retained by the spring arms 120, 121, and by the channel seats 122.

Figure 4:
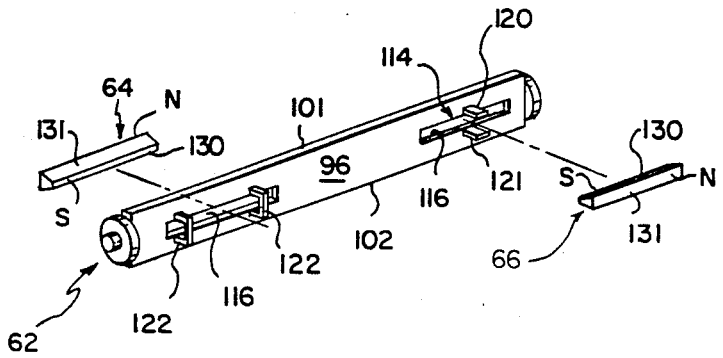
FIG. 4 is a detailed illustration of the particle moving member and first magnets of the present invention.
Figure 5:
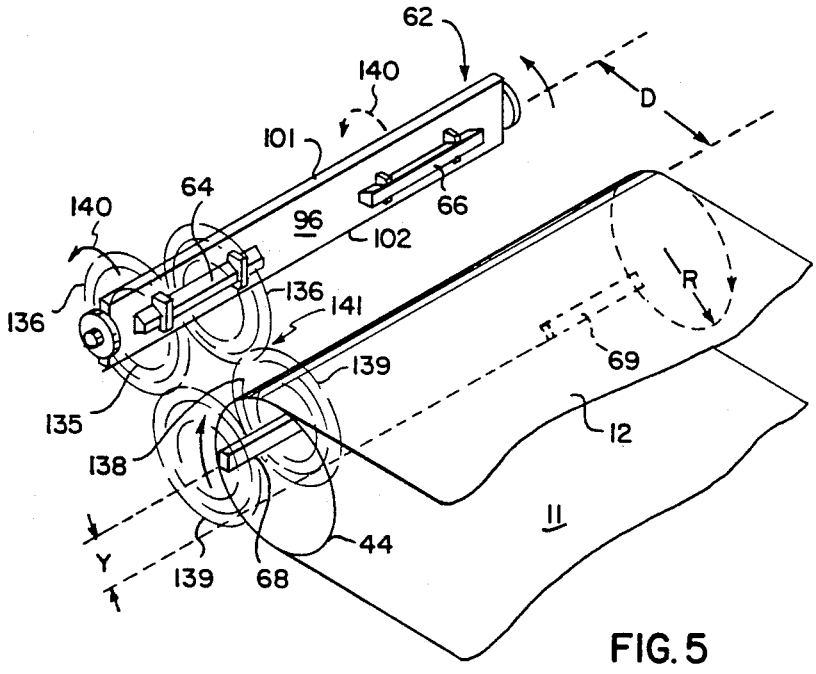
FIG. 5 is an illustration of the arrangement and operating principles of the toner-moving components of the present invention.

Each first magnet, for example, 64 (FIG. 4), which can be a permanent magnet, is elongate and wedge-shaped, with a narrow top 130 and broad base 131. Each magnet 64 or 66, for example, is polarized from top to base, such that the narrow top 130 is one pole and the broad base 131 is the other pole. As shown in FIGS. 4, 5 and 6, the narrow top 130 is south, and the broad base 131, is north. In addition, each such first magnet is loaded into the holding means 114 on the member 62 by inserting the narrow top 130 first, between the inclined spring arms 120, 121, thereby spreading the spring arms and allowing the entire magnet lengthwise to fit through the aperture 116 until the narrow top 130 comes to rest on the channel seats 122.

As shown in FIG. 4, two holding means 114, each with its arrangement of spring arms 120, 121 and channel seats 122, are formed so that the near end first magnet 64 when loaded into its holding means, is opposite in polarity to the far end first magnet 66 loaded into its holding means. In other words, the south pole of first magnet 64 and the north pole of first magnet 66 will be on the same side 96 of the member 62. As is well known, each first magnet 64 or 66, for example, generates a first magnetic field 135 (FIG. 5) with magnetic lines of force 136 running from one to the other pole of the magnet.

Referring now to FIGS. 2 and 5, the toner moving member 62, as mounted rotatably in the front portion 56 of the housing 50, and as incorporating the first magnets 64, 66 can be made to rotate if the second magnets 68, 69 which are mounted on the driven member 44, are moved in the direction and at a velocity shown by the arrow 70, past the first magnets 64,66. The driven member 44 is preferably a roller that can be mounted to the cartridge 42 by means of brackets (not shown) connected to the mounting portions 75, (FIG. 3) of the cartridge. When mounted to the cartridge as such, the driven member is spaced a small distance away from the front wall 74 of the housing 50.

The cartridge 42, can also be a disposable component which is attachable to the mounting structure for the driven member 44. As such, an attached cartridge 42 when full, is disposed with the waste toner, and replaced with a new cartridge 42. An advantage of attaching cartridge 42 to the structure supporting member 44 is that cartridge 42 maintains a correct orientation with respect to member 44, despite movement of member 44 which may be gimballed or the like.

When the surface to be cleaned is of a flexible belt member 11 as shown in FIGS. 2 and 5, the belt is trained over the driven member 44 through the small spacing between member 44 and the front wall 74. When the member 44 is a rigid drum, the second magnets 68, 69 are preferably mounted within such drum behind its image-bearing surface 12. As is also shown in FIGS. 2 and 5, the driven member may also be one of the rollers 14, 16 (FIG. 1) about which the flexible belt image-bearing member 11 is trained.

The second magnets 68, 69 are preferably mounted very close to the periphery of the member 44. The path of travel 70 of the magnets 68, 69 will therefore be approximated by the radius R of the member 44. When the member 44 is mounted to, and moved relative to the cartridge 42, the closest point between the centers of the first magnets 64, 66 and the second magnets 68, 69 is represented by a distance D.

Second magnets 68, 69 which can be permanent magnets, are each equally as long as first magnet 64 or 66. Each such second magnet may also be wedge-shaped, with a top 130 and a base 131, and each is also polarized top to base such that the narrow top 130 (FIG. 6) is one pole, and the broad base 131 is the other pole. As illustrated (FIG. 6) the narrow top 130 is south, and the broad base 131 is north. When mounted on the driven member 44, the magnets 68, 69 are oriented such that one pole leads the other pole along the path of travel 70 (FIG. 6). As shown in FIGS. 2 and 5, magnets 68, 69 are mounted on the member 44 in a common orientation with like poles south leading, and like poles north trailing in the path of travel.

In addition, magnets 68, 69 are mounted on the member 44 so as to make cooperating first and second magnets 64 and 68, and 66 and 69, as closely aligned laterally as possible. As a consequence, second magnet 69 will travel so as to come parallel to first magnet 66, when at a distance D from such first magnet. Second magnets 68, 69, as shown in FIG. 5, are also mounted off-set by a distance Y, circumferentially about the member 44. Although only second magnets 68 and 69 are shown, there can be a similarly spaced alternating pattern of such magnets around the periphery of the member 44. Again, as is well known, each such second magnet, for example, magnet 68 (FIG. 5), generates a magnetic field 138, with magnetic lines of force 139 running from one to the other pole of magnet.

Referring particularly to FIGS. 2, 5 and 6, the driven member 44 is mounted to the cartridge 42 so that when a second magnet, for example, magnet 68, on the driven member, is within the distance D from its cooperating first magnet 64 on member 62, the second magnetic field 138 generated by the second magnet 68 will overlap the first magnetic field 135 generated by the first magnet 64 (FIG. 5). The overlapping of the magnetic fields creates a magnetic coupling 141 that is capable of transferring the momentum of the 68 to the first magnet 64. The momentum transferred (a force x time quantity) depends on the combined strengths of the magnetic fields 135, 138 and on the time it takes the second magnet 68 and its field 138 to completely pass through the first field 135. The velocity, indicated by the arrow 70, of the second magnet 68 relative to the first magnet 64, given the combined strengths of the magnetic fields 135, 138 must be such as would generate and transfer a magnetic momentum that will exceed that required to overcome the inertia or tendency of the toner moving member 62 (as loaded with first magnets 64, 66) to remain stationary. Preferably, the strengths of the cooperating magnets 64 and 68, and the velocity, indicated by the arrow 70, of the second magnet 68, should be such as to transfer a momentum to the toner moving member 62 that not only overcomes the inertia of the member 62, but is large enough to cause member 62 to exert a net mechanical force 140 upon being moved.

The mechanical force 140 should be such as will enable a plow edge 101 or 102 of member 62, when laddened with toner particles, to flip such particles from the front portion 56 to the rear portion 54 of the housing 50. The quantity of toner particles to be flipped each time, is a function of the time between flips or in other words, is a function of the distance Y between second magnets 68, 69. This is because the principle of operation between cooperating first and second magnets 66 and 69 is exactly the same as that between first and second magnets 64 and 68, as described above. The operation of cooperating magnets 66 and 69, of course, lags that of magnets 64 and 68 because of the offset Y of second magnet 69 from second magnet 68.

Figure 6C:
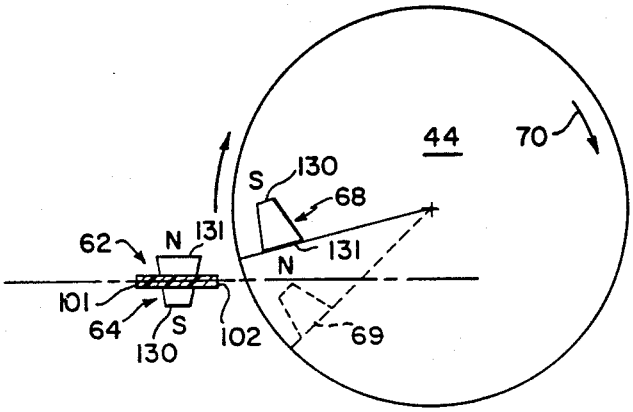
FIGS. 6A–6C are detailed illustrations of the effect of the interaction between a second magnet of the present invention being moved past a first magnet.
Figure 6B:
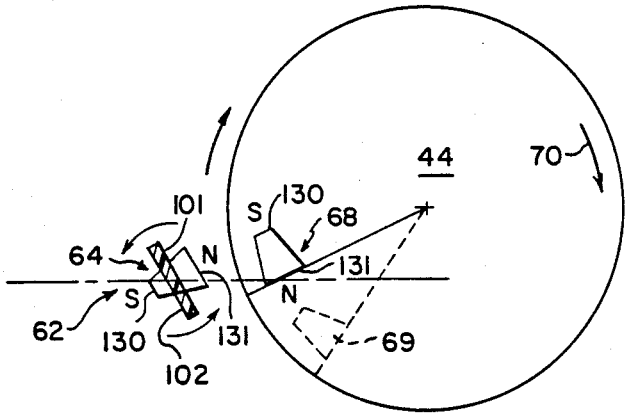
Figure 6A:
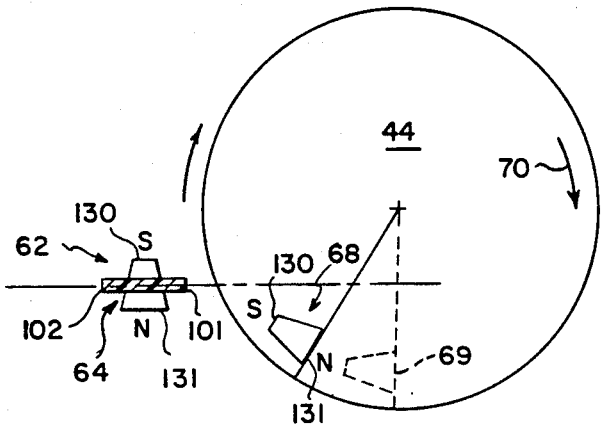

As shown in FIGS. 6A–6C, one motion of second magnet 68 past cooperating first magnet 64 is sufficient to rotate the first magnet 64, and hence the toner moving member 62, approximately 180°. One result of this rotation is to invert the first magnet 64 from an orientation where its north pole was down and its south pole up, to an orientation where the reverse is true. Because the far end first magnet 66 which cooperates with the far end second magnet 69, was loaded onto the member 62 in a reverse orientation to that of first magnet 64, the result of the 180° rotation is also to place the far end first magnet 66 in the same starting orientation (north down, south up) as first magnet 64. Since the far end second magnet 69, which cooperates with first magnet 66, was mounted to member 44 in the same orientation as the near end second magnet 68, the interaction between the far end cooperating magnets 66 and 69, is exactly the same as that between the near end magnets 64 and 68. The result again is another 180° rotation of the toner moving member 62.

As shown in FIGS. 6A–6C, the preferred mounting of each cooperating set of magnets is such that the south pole of second magnet 68, as it moves towards and past first magnet 64, will attract the north pole of first magnet 64, pulling such north pole, and hence the side of number 62 on which it is located upwards. As the leading south pole of second magnet 68 starts to move away from first magnet 64, the trailing north pole of magnet 68, which is now closer to magnet 64, acts to repel the north and attract the south poles of magnet 64, again pulling magnet 64 upwards. The effect of such upward pulling is to cause member 62 to rotate about 180° degrees about its axis within the front portion 56. Far end cooperating magnets 66 and 69 also cause a similar rotation in member 62. During these repeated rotations of member 62, the plow edges 101 and 102 sweep through the trough of the front portion 56, to effectively move the toner particles from such front portion into the rear portion 54 of the housing 50.

Although the invention has been described in detail with particular reference to the preferred embodiments thereof, it will be understood that variations and modifications can be effected within the scope and spirit of the invention.

What is claimed is:

1. A device suitable for receiving and holding particles, such as particles of toner removed from an image-bearing surface in an electrostatographic copier or printer, includes a magnetic member that is movable by a driven magnet for spreading such particles within the apparatus.

2. A cleaning apparatus for removing toner and other particles from a surface, such as an image-bearing surface in an electrostatographic copier or printer, includes a cleaning element, a housing for holding the particles removed from the surface being cleaned, and a first magnetic member within said housing movable for spreading the particles within said housing.

3. A cleaning apparatus for removing toner and other particles from the surface of a moving member, such as an image-bearing surface of a moving image-bearing member in an electrostatographic copier or printer, includes a magnetic member located within a housing for holding the particles removed from such surface, and a magnet being moved outside said housing by the moving member whose surface is being cleaned, causing said magnetic member within said housing to also move.

4. A cleaning apparatus for removing toner particles from a surface of an image-bearing member in an electrostatographic copier or printer, the apparatus comprising:

(a) a cleaning cartridge for removing and holding such toner particles, said cartridge including a toner moving member for moving the toner particles within said cartridge, a first magnet associated with said toner moving member, said first magnet generating a first magnetic field within said cartridge;

(b) a driven member, spaced from and movable at a first velocity relative to said toner moving member, said driven member having a second magnet associated therewith, said second magnet generating a second magnetic field about said driven member;

(c) means for driving said driven member;

(d) a magnetic coupling, for transferring a momentum of said driven member to said toner moving member defined by said second magnetic field moving with said driven member at said first velocity through said first magnetic field; and (e) a mechanical force, exerted within said cartridge by said toner moving member being moved by said magnetic coupling, for moving toner particles.

5. The invention as set forth in claim 4 wherein said cleaning cartridge further includes:

(a) a cleaning member having a support portion and a cleaning tip for removing toner particles from a surface of such an image-bearing member;

(b) a housing having an interior defined by a base, two end walls, front and back walls, a cover, and an opening for receiving the toner particles;

(c) first support means within said housing for supporting said cleaning member; and (d) second support means within said housing for supporting said toner moving member.

6. The invention as set forth in claim 4 wherein said toner moving member further comprises:

(a) an elongate paddle having stub shaft ends, first and second sides, and first and second plow edges; and (b) means associated with said paddle for holding said first magnet such that the first magnetic pole of said first magnet is on said first side of said paddle, and the second and opposite magnetic pole of said first magnet is on said second side of said paddle.

7. The invention as set forth in claim 4 wherein said first magnet is a permanent magnet.

8. The invention as set forth in claim 4 wherein said toner moving member has associated therewith a plurality of said first magnets.

9. The invention as set forth in claim 4 wherein said driven member has a peripheral portion thereof and means disposed in said peripheral portion for holding said second magnet.

10. The invention as set forth in claim 4 wherein said second magnet is a permanent magnet.

11. The invention as set forth in claim 4 wherein said driven member has associated therewith a plurality of said second magnets.

12. The invention as set forth in claim 4 wherein said driven member has a path of travel that lies in close proximity to said first magnet in said cartridge.

13. The invention as set forth in claim 4 wherein said first magnetic field and said second magnetic field are together strong enough, when forming said magnetic coupling, so as to exert a net force on said toner moving member that is substantially equal to the sum of said mechanical force for moving toner particles within said cartridge and a force for overcoming the inertia of said toner moving member.

14. The invention as set forth in claim 4 wherein said first velocity of said driven member, and said second magnet, moving through said first magnetic field is such that the time it takes for said second magnet on said driven member to completely move through said first magnetic field, is long enough to enable the development of a magnetic momentum in said first magnet, large enough to move said toner moving member so as to exert said mechanical force for moving toner particles within said cartridge.

15. The invention as set forth in claim 4 wherein said driven member is a roller.

16. The invention as set forth in claim 5 wherein said interior of said housing includes a raised front portion for receiving the toner particles removed by said cleaning member, and a rear portion for storing the toner particles moved from said front portion by said toner moving member.

17. The invention as set forth in claim 5 wherein said cleaning member is positioned near the tops of the walls of said housing such that said cleaning tip is over and projects beyond the front wall.

18. The invention as set forth in claim 5 wherein said support portion of said cleaning member is flexible.

19. The invention as set forth in claim 5 wherein said opening for receiving the toner particles, and said cleaning member are located such that said opening is directly and immediately below said cleaning tip of said cleaning member.

20. The invention as set forth in claim 5 wherein said means for supporting said cleaning member consists of a plurality of spaced vertical members within said housing running parallel to the end walls of said housing, and of stub pins at the tops of said vertical members for fastening to said support portion of said cleaning member.

21. The invention as set forth in claim 5 wherein said means for supporting said toner moving member consists of a first bearing hole located in one of the end walls and a second bearing hole located in the other end wall directly opposite said first bearing hole.

22. The invention as set forth in claim 6 wherein said paddle is axially flexible.

23. The invention as set forth in claim 6 wherein said means for containing said first magnet further comprises:

(a) an aperture in said paddle having a width less than the width of said paddle so as to lie between said first and said second plow edges of said paddle;

(b) first and second spring arms located adjacent said aperture on said first side of said paddle for receiving and retaining said first magnet on said first side; and (c) a plurality of thin strip U-shaped channel seats connected to said second side of said paddle, straddling said aperture, for supporting said first magnet on said second side of said paddle.

24. The invention as set forth in claim 6 wherein said paddle further includes strengthening ribs on said first and said second sides.

25. The invention as set forth in claim 7 wherein said permanent magnet is elongate and wedge-shaped, and has a long narrow top, and a long broad base.

26. The invention as set forth in claim 8 wherein said plural first magnets are divided into a first group and a second group, such that as mounted on said toner moving member, the magnetic poles of said second group of said first magnets are in a reverse orientation to the magnetic poles of said first group of said first magnets.

27. The invention as set forth in claim 10 wherein said second magnet is elongate and wedge-shaped, and has a long narrow top, and a long broad base.

28. The invention as set forth in claim 11 wherein said plural second magnets are mounted on said driven member in a common orientation of magnetic poles.

29. The invention as set forth in claim 11 wherein said plural second magnets are divided into at least a first group and a second group such that said second group of said second magnets is offset peripherally on said driven member from said first group of said second magnets, so as to substantially lag said first group of said second magnets in moving through said first magnetic field.

30. The invention as set forth in claim 6 wherein said raised front portion of said interior is troughed.

31. The invention as set forth in claim 16 wherein said rear portion of said interior is partitioned into a plurality of sections by vertical members running parallel to the end walls and from the back wall to said raised front portion of said interior.

32. The invention as set forth in claim 19 wherein said opening for receiving the toner particles includes a flexible pickup blade for picking up and directing the toner particles through said opening, into said cartridge, said pick-up blade being connected to the top of the front wall, forming the lower edge of said opening and projecting beyond said front wall to contact and seal against the surface being cleaned.

33. The invention as set forth in claim 25 wherein said permanent magnet is polarized such that said long narrow top is one magnetic pole, and said long broad base is the opposite magnetic pole.

34. The invention as set forth in claim 27 wherein said second magnet is also polarized such that said long narrow top is one magnetic pole and said long broad base is the opposite magnetic pole.

* * * * *